US005339232A

United States Patent [19]

Lin

[11] Patent Number: 5,339,232

[45] Date of Patent: Aug. 16, 1994

[54] MINIATURE LIGHT SET

[76] Inventor: Te H. Lin, No. 34, alley 39, Lane 452, Pei-Da Rd., Hsin-chu city, Taiwan

[21] Appl. No.: 3,454

[22] Filed: Jan. 12, 1993

[51] Int. Cl.[5] ..... F21V 21/00

[52] U.S. Cl. ..... 362/391; 362/226; 439/505

[58] Field of Search ..... 362/391, 226; 439/505, 439/417, 686, 694

[56] References Cited

U.S. PATENT DOCUMENTS

| | | | |
|---|---|---|---|
| 2,692,374 | 10/1954 | Carson | 362/226 |
| 2,884,555 | 4/1959 | Peterson | 439/694 |
| 3,874,764 | 4/1975 | Volinskie | 439/686 |
| 4,763,232 | 8/1988 | Woodside | 362/391 |
| 4,999,751 | 3/1991 | Chen | 362/226 |
| 5,104,336 | 4/1992 | Hatanaka et al. | 439/417 |
| 5,109,324 | 4/1992 | Ahroni | 362/391 |

*Primary Examiner*—Richard A. Bertsch
*Assistant Examiner*—Michael I. Kocharov
*Attorney, Agent, or Firm*—Larson and Taylor

[57] ABSTRACT

A miniature light set comprises lamps, lamp bases, lamp holders and a ribbon cord with three or more wires. Each of the lamp holders has a socket at one end which receives a lamp base and a wireway at the opposite end. The wireway has two upstanding elongate walls which define an elongate channel therebetween for receiving the ribbon cord, and has a transverse pressing bar at each end of the channel. Mounted on the outside of each wireway wall is an engagement lug. A pair of conductor plates are positioned in a bulb socket into which a lamp can be inserted with the lamp lead wires in contact with the plates. The other ends of the conductor plates project into the wireway and make contact with conductors in corresponding stripped portions of the wires. A snap-on cover has a base and two depending U-shaped sides that can engage the lugs and lock the cover on the wireway. On the underside of the cover base are two press bars and two press bits which are located between the lampholder pressing bars when the cover is installed. The location of the press bits correspond to the location of the conductor plates. With the engagement of the snap-on cover on the lampholder, the cord is bent and retained by the pressing bars of the snap-on cover and the pressing bars of the wireway.

20 Claims, 9 Drawing Sheets

MINIATURE LIGHT SET

FIELD OF THE INVENTION

The present invention relates in general to light sets and relates in particular to miniature light sets incorporating a combined parallel and serial circuit design, and to a method and apparatus for manufacturing such light sets.

BACKGROUND OF THE INVENTION

Conventionally a light set is manufactured as a bundle of interwoven wires with a plurality of lampholders containing lamps electrically and physically mounted at suitable locations along the bundle of wires. Manufacturing the light set in this way requires a lot of time and labor and the resulting overall appearance is not very good. The lampholder in this type of light set also requires an interactive connection between the terminals and the wires which means that there is more than one constraint to consider in the circuit design. This constraint defeats the usefulness of the feature. Finally, because each lampholder is connected in series, the failure of any one lampholder or lamp in the entire light string will result in the failure, inoperability and extinguishment of the entire light set.

In view of the foregoing shortcomings, there have been some improvements developed by the industry. For example, Taiwan patent application number 7,329,609 filed suggests the use of an integrated cord to serve the purpose of connecting the wire through the lamp. It also suggested the use of a lampholder having a base with a bottom opening and an end cover with metal prongs or pikes on it. During assembly the wire is passed through the lampholder base and the end cover is installed so that the prongs penetrate specifically furnished insulation layers on the cord and contact the metal conductor core to make the electrical connection.

However, the lamp set of the Taiwan patent application still suffers from a number of deficiencies. Because the operability of the miniature light circuit depends upon the penetration of the metal pikes into the enclosed conductor, there is often a question as to the satisfaction of the requirements of stability and reliability. Indeed, in the packing or operation of such miniature light strings, if the cord is subjected to repeated bending or folding near a lampholder, the string will very often suffer a poor conductivity between the pikes and the core conductor.

Also, according to the circuit design of the Taiwanese patent application, the lamp set is comprised of a parallel connection of a plurality of strings of lamps connected in series. Thus, the burning out of any one particular lamp will not result in the total inoperability of all of the remaining lamps. However, there is also no denying that when one particular lamp of any string fails, all of the other bulbs in that string will also be extinguished.

SUMMARY OF THE INVENTION

Recognizing the deficiencies and drawbacks of the conventional lamp string or light set assemblies, the present inventor has betaken of himself to obtain further improvements.

The present invention incorporates several principals and features. It utilizes the parallel-series circuit design to ensure the trouble-free functioning of the light set. Even though one lampholder may fail or a bulb becomes loose or burns out in one of the series strings, all the other lamps in the other strings will continue operating unaffected as usual. The present invention also utilizes wires in which the insulation layer is stripped off to expose the central conductor at those locations corresponding to the location of the conductor plates of the lampholder. Thus the conductivity of the circuit is completely assured by utilizing close contact between the stripped portion of the wires and the conductor plates. In addition the correlation between the lampholder and the corresponding elements to be retained therein has been optimized such that the conductor plates can be reliably and dependably physically forced into contact with the stripped portion of the wires. This results in the elimination of any poor electrical contact and assures good conductivity even if the wire is exposed to repeated bending or folding, or other abuses.

These and further features and advantages of the present invention will be described in greater detail and will be better appreciated by referring to the accompanying drawings and the descriptions set forth hereinbelow.

Figure 12:
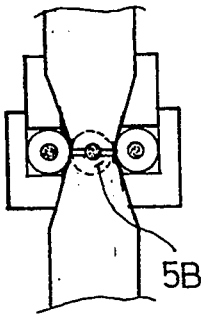
FIG. 12 is a schematic cross-sectional end view showing one of the cutters cutting into the wire insulation without cutting the center conductor.

FIG. **12*a* is an enlarged schematic elevational view of the cutting blade of FIG. 12**.

Figure 13:
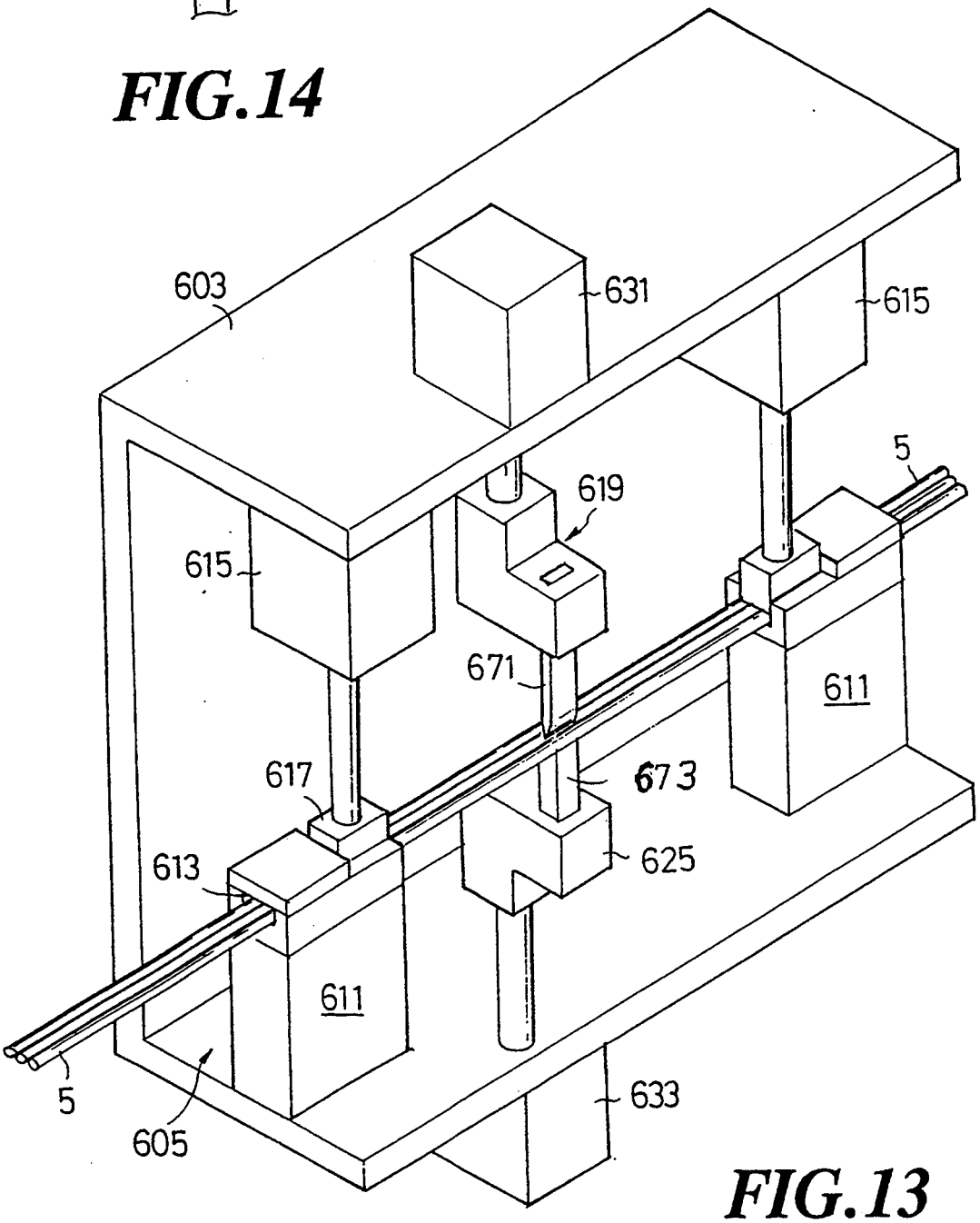

FIG. 13 is a schematic perspective view of a third station of the stripping machine, the insulation of a particular wire being axially or longitudinally cut at this particular station.

Figure 14:
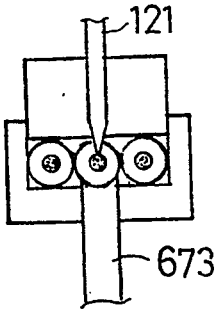

FIG. 14 is a schematic cross-sectional end view showing the cutter cutting the length of insulation between the two circular cuts.

Figure 15:
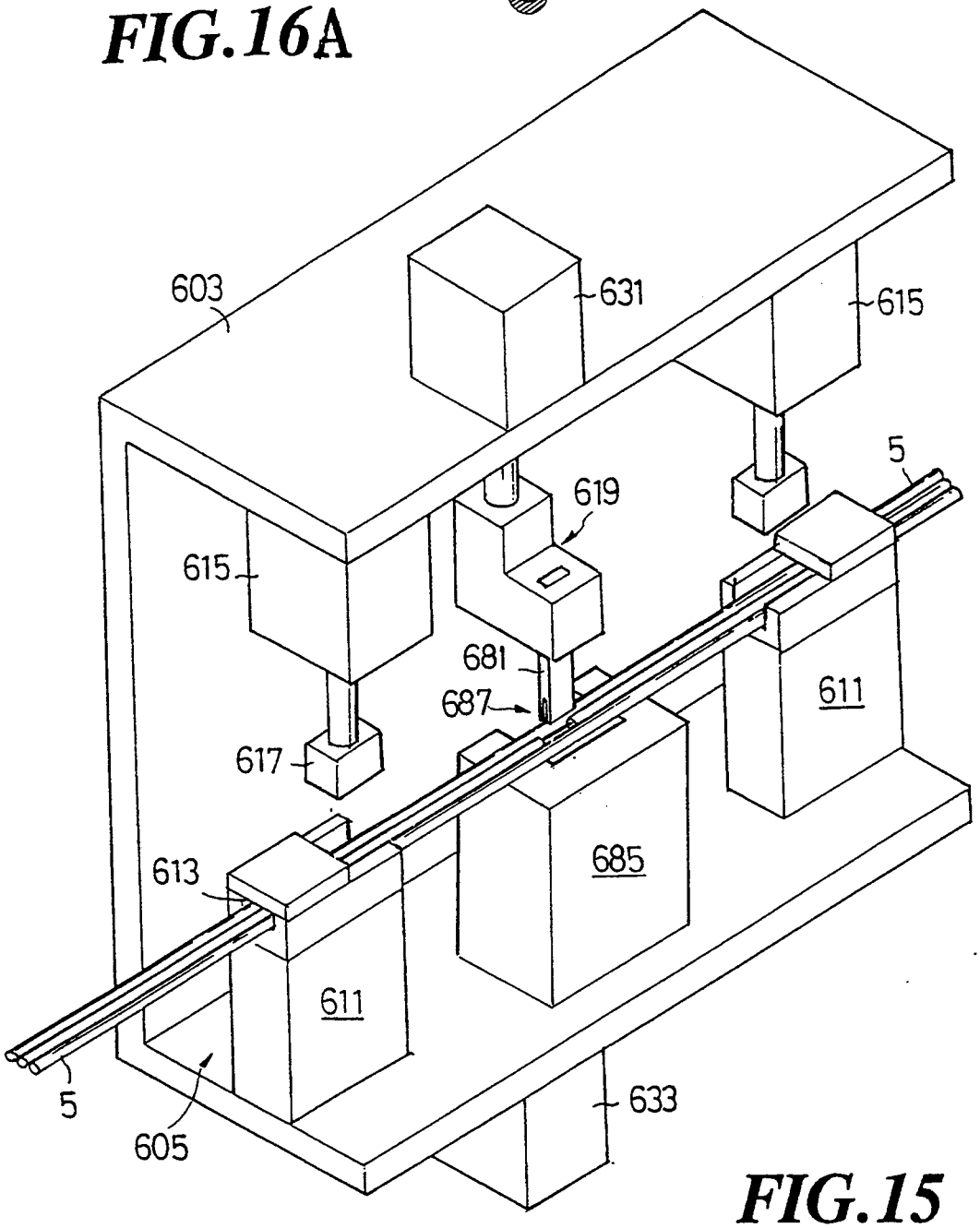

FIG. 15 is a schematic perspective view of a fourth station of the stripping machine, the insulation of the wire being removed at this particular station.

Figure 16A:
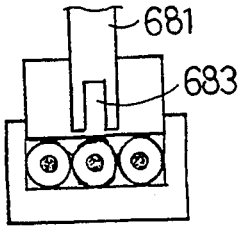
Figure 16B:
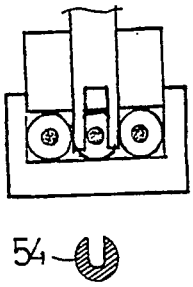

FIG. 16*a* and 16*b* are schematic cross-sectional end views showing the steps in removing the cut insulation section from the selected wire without affecting the other two wires.

DETAILED DESCRIPTION OF THE PREFERRED EMBODIMENTS

Figure 1:
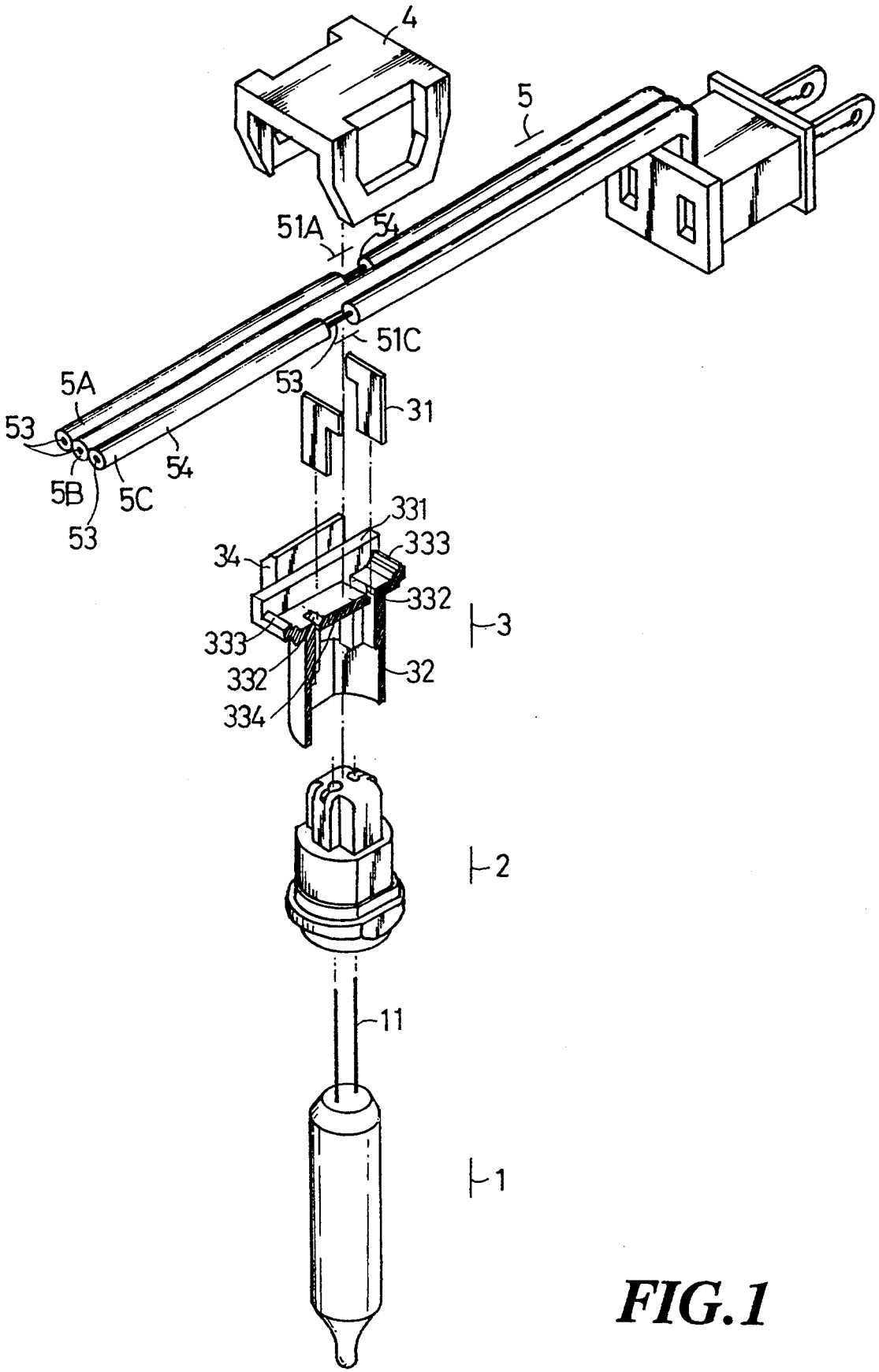
FIG. 1 is a three-dimensional, exploded perspective view, partially in section, of the present invention.

With reference now to the figures in which like elements are denoted by the same numeral, and in particular with reference to FIGS. 1, a light set in accordance with the present invention is depicted. The light set is comprised of a plurality of lamps 1, each mounted in a socket 2, which in turn is mounted in a lampholder 3. A cover 4 is provided for each lampholders 3 so that a ribbon cord 5 can be mounted on the top of lampholder 3. Each lamp 1 is conventional and includes 2 wires 11 which extend through socket 2 when lamp 1 is mounted therein.

Figure 2:
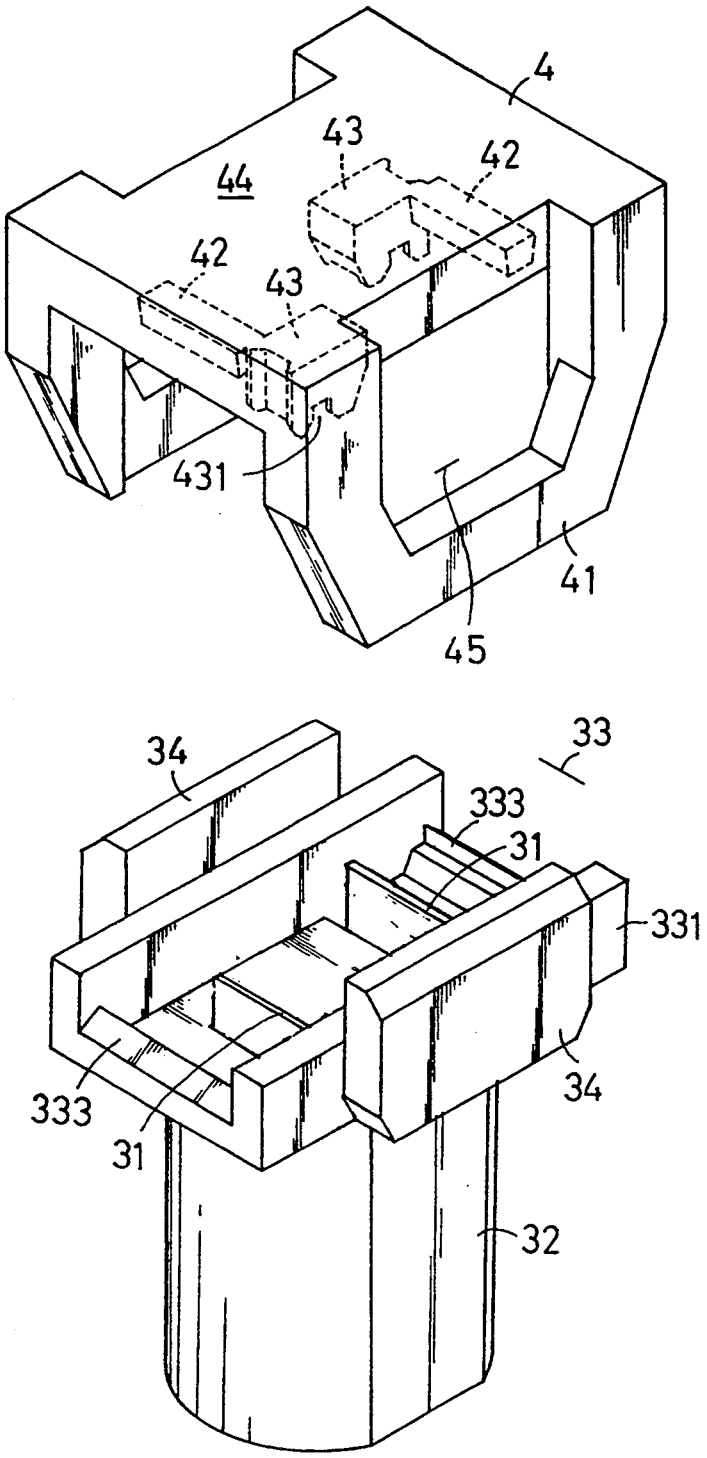
FIG. 2 is an exploded perspective view of the lampholder and snap-on cover.
Figure 3:
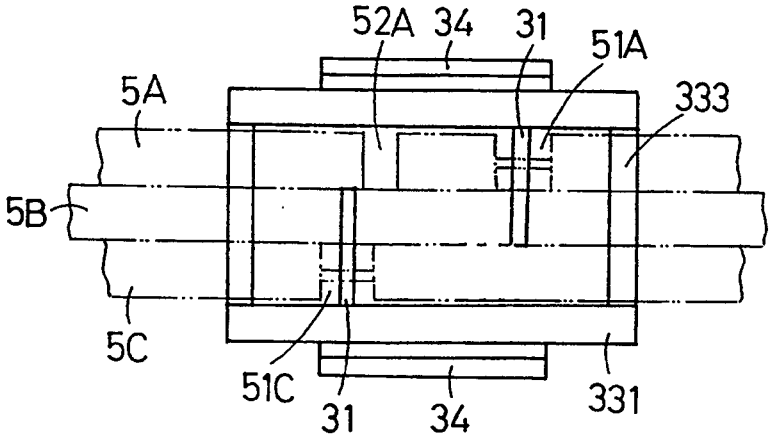
FIG. 3 is a top plan view of the wireway of the lampholder depicting in phantom the position of a ribbon cord containing three wires.

Lampholder 3 is comprised of a lower housing 32 and an upper wireway 33 (see FIG. 2). Wireway 33 is adapted to receive a cord 5, which in the preferred embodiment is comprised of three coplanar wires, an outer wire 5A, a central wire 5B, and an outer wire 5C. Each wire 5A, 5B and 5C is comprised of a central conductor 53 and an outer sheath of insulation 54. Cord 5 is sometimes called a three wire ribbon cord. Outer wires 5A and 5C have stripped portions 51A and 51C, respectively, in which a portion of insulation 54 has been removed so as to expose conductor 53. Stripped portions 51A and 51B are longitudinally located on wireway 33 and staggered so that no part of stripped portions 51A and 51B overlap. In addition, as explained hereinbelow, wire in FIG. 3, 5A is shown with a cutout 52A located within wireway 33.

Wireway 33 is comprised of two elongated, spaced apart, parallel upstanding walls 331 connected together by a base 334. Two transversely extending pressing bars 333 extend upwardly to a suitable height from and are perpendicular to base 334. Pressing bars 333 have two planar sides and are connected at each end to the two walls 331. Base 334 has two vertically extending cavities 332 therein. A metal, elongate conductor plate 31 having an inverted "L" shape is received and retained in each cavity 332 and extend from a position just above base 334 downwardly into housing component 32. Rigidly mounted on the outside of each wall 331 is a solid coupling lug 34 that is provided with parallel planar sides and a beveled bottom. Each lug 34 is shorter than its corresponding wall 331, and is centered longitudinally on it, but extends above it. Lugs 34 are located directly opposite each other on wireway 33 and are configured and located so as to retain a snap-on cover 4 that can be removeably mounted on wireway 33.

As depicted more clearly in FIG. 2, snap-on cover 4 has an overall inverted U-shape and includes a base 44 and depending arms 41 on each side of base 44. Mounted on the lower surface of base 44 are two transversely extending press bars 42 and two longitudinally extending press bits 43. Each cover arm 41 is provided with a relatively large central opening 45 that has a size and shape so as to permit arms 41 to fit over and closely engage lugs 34.

Figure 6:
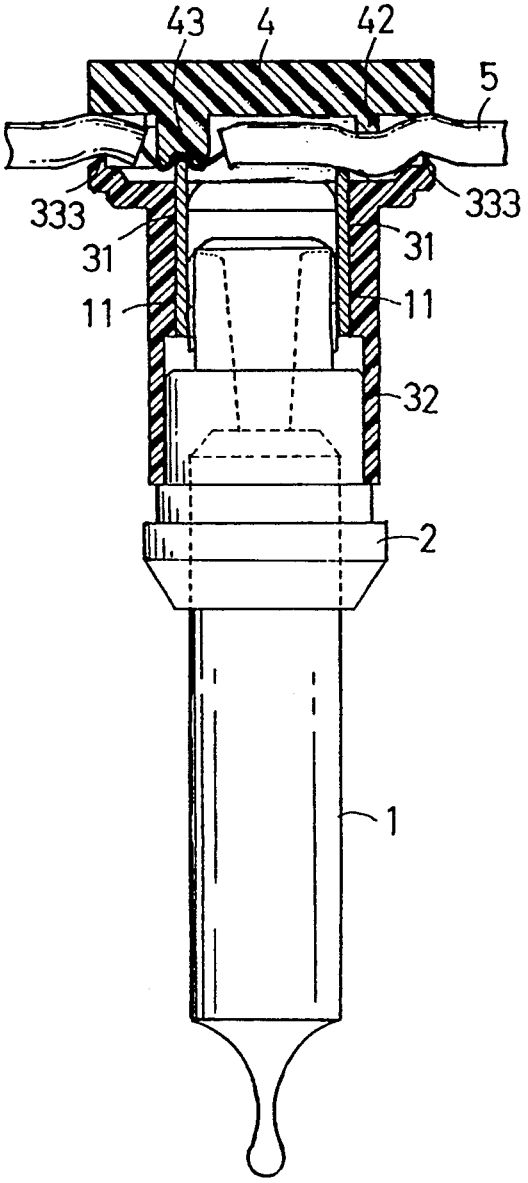
FIG. 6 is a front elevational view, partly in cross section, of the assembled lampholder depicted in FIG. 1.

As particularly shown in FIG. 6, press bars 42 are aligned and have a size and shape so as to be accommodated in the space between pressing bars 333 when cover 4 is mounted on wireway 33 and to depend into the space defined by walls, but their lower ends terminate above the top of pressing bars 333. Further, press bars 42 do not extend transversely all the way between walls 331. Press bits 43 are formed with a recess 431 in the lower end thereof which extends in the transverse direction. Press bits and recess 431 have a location on cover 4 so as to mate with the upper end of conductor plate 31. The spacing between recess 431 and conductor plate 31 is slightly smaller than the size of the wire so that the conductor portion 53 of the wire can contact the top end of conductor plate 31 when cover 4 is mounted on wireway 33.

As seen in FIG. 3, stripped portions 5A and 5C are located along cord 5 such that when cord 5 is mounted within wireway 33, the exposed conductors 53 contact the tops of conductor plates 31. The cutouts 52A or 52C of wire 5A or 5C respectively are located inside lampholder 3 somewhere between pressing bars 333.

Figure 4:
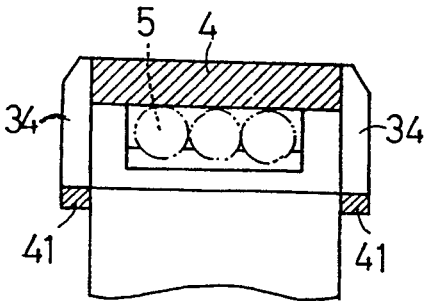
FIG. 4 is a side elevational view, partly in cross-section of an assembled lampholder and cover depicted in FIG. 2 depicting in phantom a ribbon cord having three wires.

Thus, when cord 5 is mounted in wireway 33 of lampholder 3 and cover 4 is applied, the application pressure on cover 4 will force the conductors of wires 5A and 5C into good electrical contact with conductor plates 31. Cover 4 is held in place by cover sides 41 engaging lugs 34. See also FIG. 4. Also as cover 4 and lampholder 3 are combined, stripped portions 51A and 51B of wires located above conductor plate 31 are compressed by press bit 43 of cover 4 and will bend to conform with cavity 431, as shown in FIG. 6, and thereby will provide a tightened contact with conductor plate 31 to make a physically secure and electrically tight circuit.

In addition, the bottom ends of press bit on either side of cavity 431 are a flat or planar surfaces so that when cover 4 is mounted on lampholder 3, these surfaces bring additional pressure on the exposed conductor 53 of cord 5.

It is noted that as cover 4 is being installed on lampholder 3, press bar 42 bends the corresponding wire because the lower end of press bar 42 extends to a height that is below the top end of pressing bar 333. This bending provides physical security against an axial pull on cord 5 as cord 5 is tightly locked and retained in wireway 33. In this way the axial position of lampholder 3 along cord 5 can be maintained.

Figure 5:
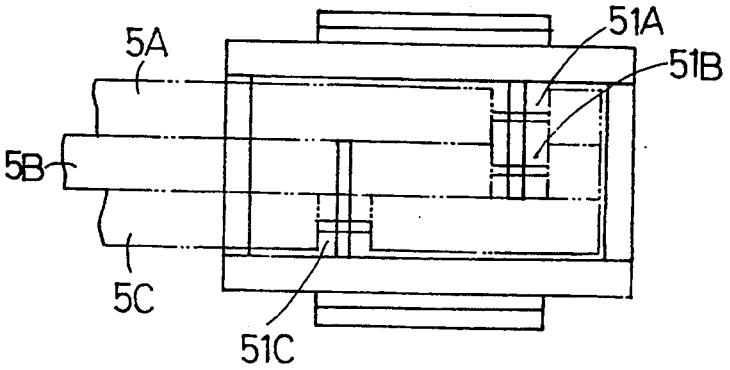
FIG. 5 is a top plan view of the wireway, similar to FIG. 3, but depicting in phantom the wiring arrangement of the terminal or last lampholder in a parallel subassembly.
Figure 7:
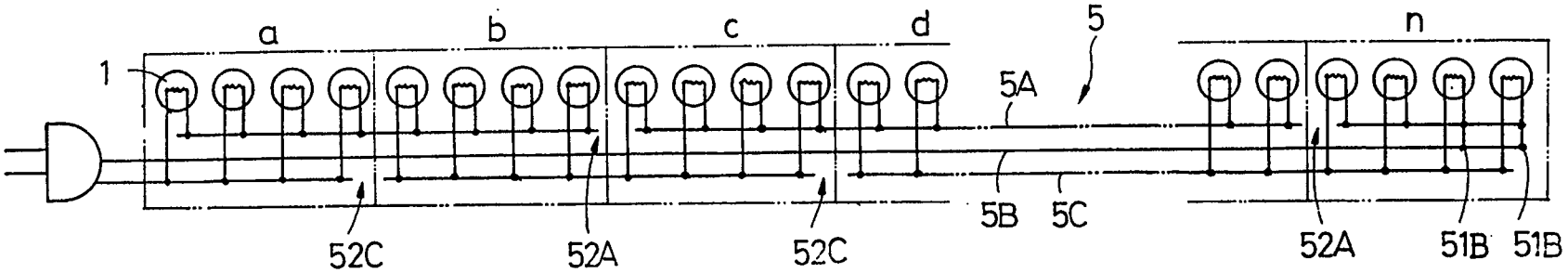
FIG. 7 is an electrical schematic of the circuitry of the present invention.

So far the present invention has been described with respect to the mounting connections between lampholder 3 and cord 5. Now, one embodiment of a circuit for a light set according to the present invention will be described with respect to FIG. 7. The light set depicted in FIG. 7 is comprised of a plurality of parallel mountings or segments a, b, c, d, . . . , n connected in series. A plurality of lamps 1 are connected to wires 11 of each parallel segment or subassembly, which in the present embodiment is four lamps. Thus, wire leads 11 of each lamp 1 are respectively connected to wires 5A and 5C and each parallel subassembly is connected in series with the next subassembly by means of wires 5A or 5C such that wires 5A or 5C will have alternating cutouts 52A and 52C at intervals of every four lamps 1. Power then is supplied from wire 5C to a first parallel subassembly "a" with four lamps 1 to wire 5A through each of those four lamps 1; from wire 5A to the second parallel subassembly "b" and then through each of the four lamps of that subassembly to wire 5C; then to subassembly "c" in the same manner; and so forth repeating this sequence all the way through the last parallel lampholder subassembly "n" and terminating on wire 5B to complete the entire closed circuitry. In the last parallel subassembly "n," the connection between wire 5A or 5C to 5B is duplicated in more than just the last lampholder, and in the embodiment depicted in FIG. 7, the connection is between wire 5A and 5C and is duplicated in the last two lampholders. As shown in FIG. 5, it can be seen that stripped portion 51B is connected to stripped portion 51A by conductor plate 31.

As can be seen in the circuitry of FIG. 7, one of the features of the present invention is that should any one lampholder 3 fail or should any lamp 1 drop out or burn out or otherwise fail, the remainder of the circuit will still be supplied with power and the lights illuminated by way of the other three lamps 1 of the affected parallel subassembly. Thus the shortcomings associated with the aforementioned conventional series wiring circuitry which becomes totally inoperative under similar circumstances. Similarly, because the last parallel subassembly "n" is designed to have wire 5A or 5C connected to wire 5B through more than just one lampholder, the integrity of the entire set is maintained such that the failure of any one lamp 1 or lampholder 3 will not cause the failure of any other part of the system.

Another safety feature of the present invention is seen with reference to FIG. 3. Cutouts 52A or 52C of wire 5A or 5C respectively are located inside lampholder 3 somewhere between pressing bars 333 rather than outside the lampholder where the cutout would be exposed. Such exposure would be harmful to the integrity of the system and even affect the safety considerations of the entire light set.

With reference now to FIGS. 9 through 16, a machine for automatically removing a selected amount of insulation only from one wire and for cutting a particular wire of cord 5 will now be described. In particular, with reference to FIGS. 9 and 10, a first station 601 of a multistation apparatus for stripping and cutting selected wires of a multiwire ribbon cord 5 is depicted.

First station 601 includes an elongate housing 603 having a channel 605 therethrough. Mounted on each end of channel 605 are a first clamp 607 and a second clamp 609. Each clamp includes a lower base 611 which includes a wireway 613 through which a cord 5 can be fed, an automatically, remotely controlled actuator 615, and a press head 617 which can be moved into a restraining contact with cord 5 by actuator 615.

Figure 10:
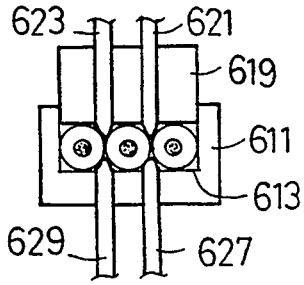
FIG. 10 is a schematic cross-sectional end view showing the cutters separating the wires.
Figure 9:
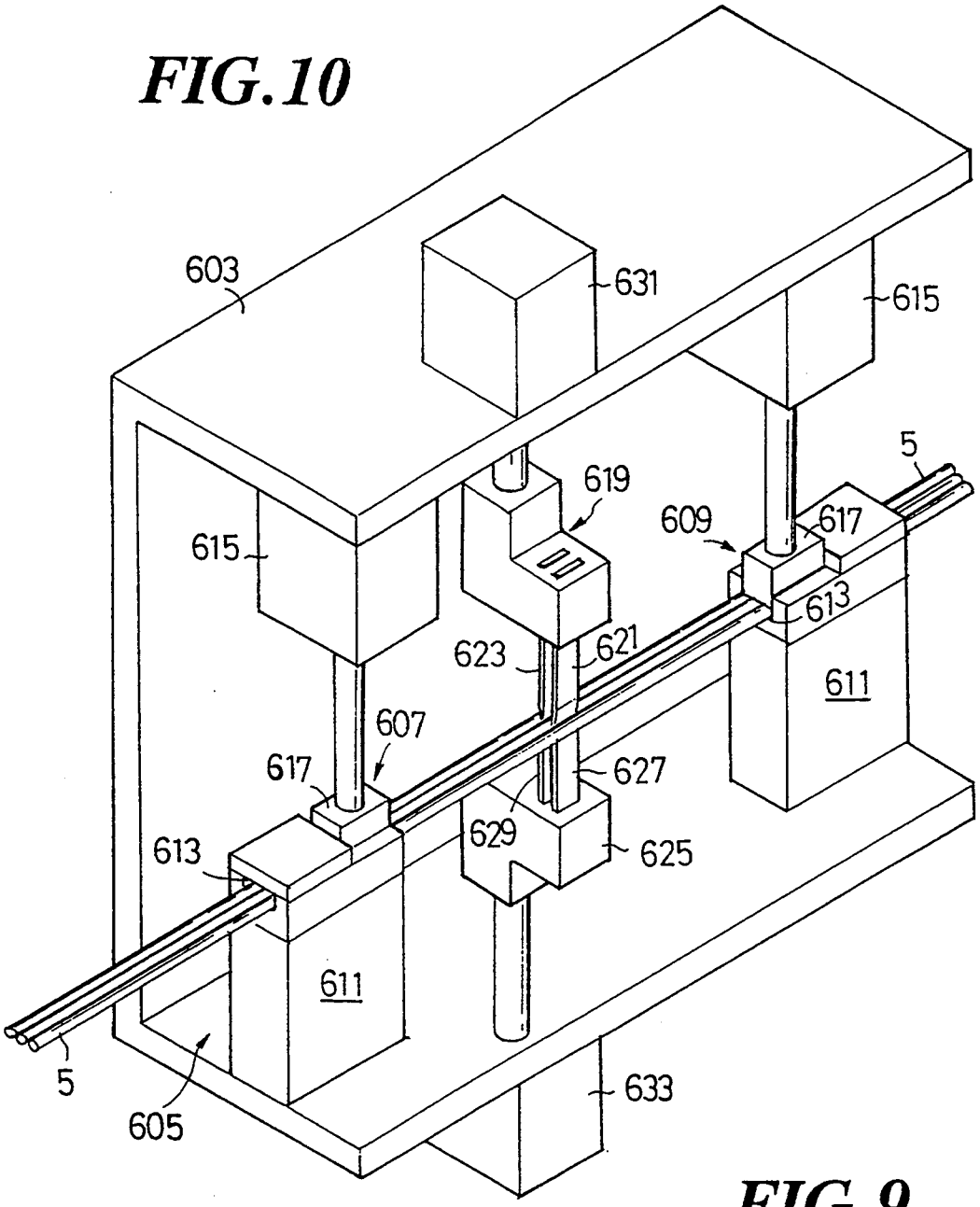
FIG. 9 is a schematic perspective view of a first station of a machine for stripping off the insulation at selective locations on selective wires, a particular wire being separated at this particular station.

First station also includes an upper tool holder 619 holding two upper dividing blades 621 and 623 and a lower tool holder 625 holding two lower dividing blades 627 and 629. An upper tool holder actuator 631 controls the vertical position of upper tool holder 619 and a lower tool holder actuator 633 controls the vertical position of lower tool holder 625. Dividing blades 621, 623, 627 and 629 have a longitudinal length in the direction that cord 5 is pulled) that is equal to the length of stripped portion 51 and are transversely spaced apart a relatively small distance which is equal to the thickness of a wire in cord 5. A cord pulling device (not shown) can accurately pull cord 5 a predetermined distance such that a selected portion of cord 5 having a wire to be stripped can be positioned between the two sets of dividing blades 621 and 623, and 627 and 629. As shown in FIG. 10, the wires of cord 5 are separated from one another in a region equal to the length of the dividing blades when actuators force the dividing blades together.

Figure 11:
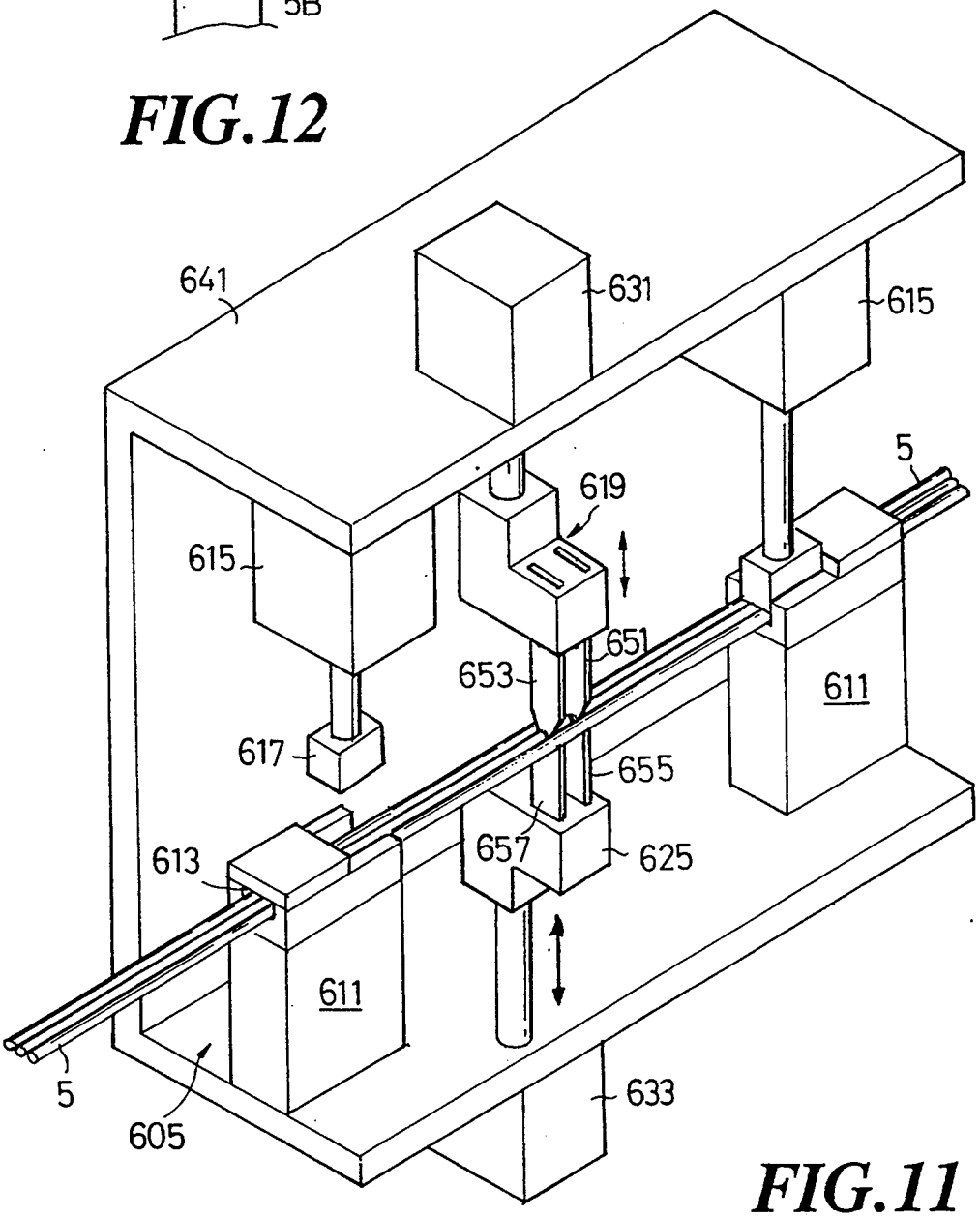
FIG. 11 is a schematic perspective view of a second station of the stripping machine, the insulation of a particular wire being circularly cut at this particular station.

In FIGS. 11, 13 and 15, a second station 641, a third station 643 and a fourth station 645 are respectively depicted. Each of the four stations are similar in that the clamps, actuators, and housing are similar. Therefor, the same numerals as used in FIG. 9 will be used in these figures. The principal difference between the stations is the type of tool in tool holders 619 and 625.

Figure 12A:
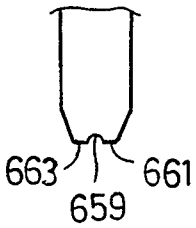

In second station 641, upper tool holder 619 holds two spaced apart blades 651 and 653 and lower tool holder 625 holds two spaced apart blades 655 and 657. Each of blades 651, 653, 655, and 657 is oriented perpendicular to cord 5 and each has a semicircular notch 659 bordered on each side by flat portions 661 and 663 (see FIGS. 12 and 12*a*). The diameter of notch 659 is approximately equal to, but slightly larger than, the diameter of conductor 53. The spacing between blade sets 651 and 653, and 655 and 657 is equal to the axial length of stripped portion 51.

In third station 643, upper tool holder 619 holds a single, longitudinally oriented blade 671 and lower tool holder 625 hold an anvil 673. The length of blade 671 equals the length of stripped portion 51. FIG. 14 depicts blade 671 in a slitting position on wire 5B as anvil 673 holds wire 5B in place.

In fourth station 645, upper tool holder 619 holds a pusher bar 681 having a transversely oriented, U-shaped notch 683 in the leading edge thereof. The width of notch 683 is about equal to the diameter of conductor 53 and the axial length of pusher bar 681 is approximately equal to the length of stripped portion 51. In fourth station 645 as depicted in FIG. 15, there is no lower tool holder, it having been replaced by a supporting block 683. Obviously, supporting block 683 can itself be replaced by a smaller embodiment thereof which is retained by lower tool holder 625. Supporting block 683 has an open middle section 685 so that cord 5 will have a flexibility as the cut section of insulation 54 is pushed down as shown in FIGS. 16*a* and 16*b*. In this way, the risk of breaking or bending conductor 53 is minimized.

Although the stripping device has been shown as having four stations, a further embodiment could have only one station and an upper and lower tool holder that is essentially a carousel holding the various tools for the operations of dividing, circular insulation cutting, and longitudinal insulation cutting, which operations can be performed in any order, and insulation removal, which operation obviously must be the last one. In addition, the foregoing description was directed to center wire 5B, but the outer wires 5A and 5C can be operated on simply by having a tool holder that can be transversely moved by actuators 631 and 633.

Figure 8:
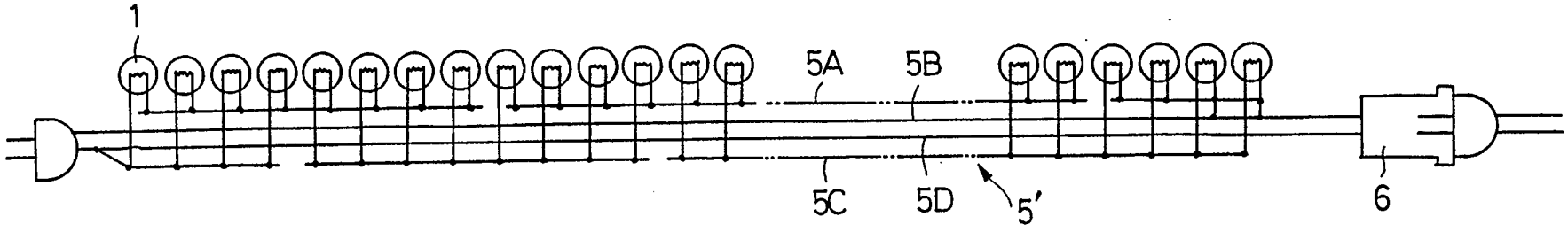
FIG. 8 is an alternative embodiment of the electrical schematic of the circuitry depicted in FIG. 7.

A further embodiment of the circuit depicted in FIG. 7 is depicted in FIG. 8 wherein there are four wires, 5A, 5B, 5C and 5D, in cord 5. This embodiment permits the installation of a socket 6 after the last subassembly "n" in the light set so that another light set can be connected.

In summary, the present invention functions essentially by the coupling of a plurality of pressing bars furnished in the wireway of the lampholder, and the conductor plates with the press bars and press bits on the snap-on cover to ensure that the cord located in the wireway is reliably secured in position, while the continuity of the circuitry is maintained at the same time. The circuit to make a closed loop utilizes the wire leads on either end of the lamp to make contact with wires 5A and 5C. The wire of each subassembly of parallel lampholders is created by alternately severing wire 5A and 5C after the fourth lampholder of that subassembly. The parallel-series circuit thereby formed provides security through redundancy to the effect that should any one lampholder or lamp fail, the normal functioning of the other lamps will not be affected.

A design such as that of the present invention has thus been demonstrated to be more advantageous with respect to the functional performance than any known conventional design of miniature light sets.

I claim:

1. In a miniature light set which includes a plurality of miniature light lamps, lamp base, lampholder and cord, the improvement comprising:

a wireway located in the upper part of the lampholder, said wireway comprising an elongate central channel formed by a central base and two upstanding walls mounted to the sides of said base, a transverse, upstanding pressing bar mounted at each end of said base, two longitudinally spaced apart cavity recesses located between said pressing bars, and said wireway further including a conductor plate mounted in each said recess; and a snap-on cover with press bars and press bits projecting downwardly underneath said cover, said press bars extending into said wireway channel between said pressing bars when said cover is mounted on said wireway such that the ends of said press bars extend to a level that is below the top end of the pressing bars, the underside of said press bit having a cavity recess therein which is aligned with said conductor plates, but is spaced therefrom when said cover is mounted on said wireway;

said cord being located in said wireway channel and being comprised of a plurality of wires, each said wire having a central conductor surrounded by a sheath of insulation, and a first and a second of said wires having a portion of said insulation stripped off at a location corresponding to the location of said conductor plates.

2. A miniature light set as claimed in claim 1, wherein the conductor portion left naked by the stripped portion of the wire located above the conductor plates, being acted upon by the press bit of the snap-on cover, is forced to bend in conformity with the cavity recess when engaged by the conductor plates.

3. A miniature light set as claimed in claim 2, wherein the underside of said press bit as part of the snap-on cover has a flat profile, and the clearance holding its terminal end apart from the contact piece is slightly smaller than the diameter of the conductor portion.

4. A miniature light set as claimed in claim 3, wherein that portion of a third wire associated with at least one lampholder and as part of the last parallel sub-assembly of said lampholder correspondent with the contact piece is stripped to form a stripped portion.

5. A miniature light set as claimed in claim 3, wherein the cord comprises a four-wire assembly, and a socket is provided at the tail of the last parallel sub-assembly of said lampholder.

6. A miniature light set as claimed in claim 2, wherein that portion of a third wire associated with at least one lampholder and as part of the last parallel sub-assembly of said lampholder correspondent with the contact piece is stripped to form a stripped portion.

7. A miniature light set as claimed in claim 2, wherein the cord comprises a four-wire assembly, and a socket is provided at the tail of the last parallel sub-assembly of said lampholder.

8. A miniature light set as claimed in claim 1, wherein the underside of said press bit as part of the snap-on cover has a flat profile, and the clearance holding its terminal end apart from the contact piece is slightly smaller than the diameter of the conductor portion.

9. A miniature light set as claimed in claim 8, wherein that portion of a third wire associated with at least one lampholder and as part of the last parallel sub-assembly of said lampholder correspondent with the contact piece is stripped to form a stripped portion.

10. A miniature light set as claimed in claim 8, wherein the cord comprises a four-wire assembly, and a socket is provided at the tail of the last parallel sub-assembly of said lampholder.

11. A miniature light set as claimed in claim 1, wherein the press bar that is part of the snap-on cover serves to compress the wire resident between the two pressing bars of the so as to bend.

12. A miniature light set as claimed in claim 5, wherein that portion of a third wire associated with at least one lampholder and as part of the last parallel sub-assembly of said lampholder correspondent with the contact piece is stripped to form a stripped portion.

13. A miniature light set as claimed in claim 1, wherein at least one of said first and second wires forms alternating cut-outs limited between two parallel lampholder sub-assemblies, so that each parallel lamp assembly may, by means of said first or second wire, or form a series connection with the next following parallel bulb mounting sub-assembly.

14. A miniature light set as claimed in claim 13, wherein each of said cut-outs of said at least one of said first and second wires lies in the space defined by both pressing bars of the lampholder.

15. A miniature light set as claimed in claim 1, wherein said lamp includes wire leads connected to either end of the lamp and linked with said first and second wires of the cord thereby forming a plurality of parallel lampholder subassemblies.

16. A miniature light set as claimed in claim 15, wherein one of said first and second wire which is connected to at least one lampholder forming part of the last parallel sub-assembly of said lampholder is connected to a third wire via a contact piece by way of the stripped area.

17. A miniature light set as claimed in claim 1, wherein at least one of said first and second wire forms alternating cut-outs limited between two parallel lampholder sub-assemblies, so that each parallel lamp assembly may, by means of said first or second wire form a series electrical connection with the next following parallel bulb mounting sub-assembly.

18. A miniature light set as claimed in claim 1, wherein that portion of a third wire associated with at least one lampholder and as part of the last parallel sub-assembly of said lampholder correspondent with the contact piece is stripped to form a stripped portion.

19. A miniature light set as claimed in claim 1, wherein the cord comprises a four-wire assembly, and a socket is provided at the tail of the last parallel sub-assembly of said lampholder.

20. A miniature light set as claimed in claim 1, wherein the outside of the wireway's walls are formed as coupling hasps; and wherein the snap-on cover has "U" shaped bridges extending down on both sides thereof.

* * * * *